US006379127B1

(12) United States Patent
Andrews et al.

(10) Patent No.: US 6,379,127 B1
(45) Date of Patent: Apr. 30, 2002

(54) SUBMERSIBLE MOTOR WITH SHAFT SEALS

(75) Inventors: Dale B. Andrews, Derry; D. Paul Russell, Kingston; Michael C. Witzgall, Derry, all of NH (US)

(73) Assignee: Lawrence Pumps, Inc., Lawrence, MA (US)

( * ) Notice: Subject to any disclaimer, the term of this patent is extended or adjusted under 35 U.S.C. 154(b) by 0 days.

(21) Appl. No.: 09/676,579

(22) Filed: Sep. 29, 2000

(51) Int. Cl.[7] ..... F04B 17/00

(52) U.S. Cl. ..... 417/423.11; 417/423.3; 277/408; 277/387; 415/109; 310/87

(58) Field of Search ..... 417/423.11, 423.3; 415/109, 111, 112, 180, 175; 310/87; 277/387, 400, 401, 408, 428, 429, 431

(56) References Cited

U.S. PATENT DOCUMENTS

| | | | | |
|---|---|---|---|---|
| 1,947,017 A | * | 2/1934 | McHugh | 277/387 |
| 2,002,907 A | * | 5/1935 | Sessions | 310/87 |
| 2,404,783 A | | 7/1946 | Blom | 277/387 |
| 2,423,436 A | | 7/1947 | Blom | |
| 2,506,827 A | * | 5/1950 | Goodner | 277/387 |
| 2,545,422 A | | 3/1951 | Blom | 277/387 |
| 2,581,504 A | | 1/1952 | Wilfley et al. | |
| 3,671,786 A | | 6/1972 | Jones | |
| 3,746,472 A | | 7/1973 | Rupp | 310/87 |
| 3,764,233 A | | 10/1973 | Strickland | |
| 3,841,791 A | | 10/1974 | Doolin | |
| 3,960,245 A | | 6/1976 | Weinrich | |
| 4,324,534 A | | 4/1982 | Sharkey | |
| 4,575,315 A | | 3/1986 | Galais et al. | |
| 4,906,166 A | | 3/1990 | Seidel | |
| 5,571,001 A | | 11/1996 | Fukuda et al. | |
| 5,616,973 A | | 4/1997 | Khazanov et al. | 310/89 |
| 5,938,205 A | | 8/1999 | Azibert et al. | 277/408 |
| 6,210,107 B1 | * | 4/2001 | Volden et al. | 277/408 |

FOREIGN PATENT DOCUMENTS

DE DT 2406918 A1 9/1975

* cited by examiner

*Primary Examiner*—Cheryl J. Tyler
(74) *Attorney, Agent, or Firm*—Vernon C. Maine; Scott J. Asmus

(57) ABSTRACT

A submersible electric motor driven pump includes a motor chamber and a pump chamber separated by a seal chamber. Inboard and outboard shaft seals immersed in an oil buffer fluid within the seal chamber restrict the flow of liquid from the seal chamber into the pump and motor chambers. An integral or externally mounted pre-pressurized buffer fluid reservoir maintains a positive fluid pressure in the seal chamber relative to the external pressure at working depth, and suitable buffer fluid level within the chamber, preventing the ingress of the pumped media through the outboard seal. A unique impeller design circulates fluid within the seal chamber in the region of the outboard shaft seal, allowing continuous run dry operation when used in conjunction with an integrally cooled motor design. A cartridge shaft sleeve subassembly permits with a bearing configured between the inboard and outboard seals, facilitates maintenance.

20 Claims, 5 Drawing Sheets

SUBMERSIBLE MOTOR WITH SHAFT SEALS

BACKGROUND OF THE INVENTION

1. Technical Field of the Invention

This invention relates to a submersible motor and seal section for a submersible motor. More particularly, it relates to a submersible motor, its ability to operate in air or submerged, and its maintainability. This invention particularly references combined submersible motor and pump units, although certain features of the present invention are useful on submersible motors that are used for purposes other than the operation of pumps.

2. Background Art

The term "submersible", as used herein means that the motor can be surrounded by a fluid, which is restricted from access to the interior of the motor by an external casing or motor housing that is integral to the motor design.

Submersible motor driven pumps are widely used for transferring liquids from sumps and wells. Generally, these pumps include a motor, and a seal section that prevents the ingress of the pumped fluid along the motor shaft. Submersible motors have been designed with both wet and dry rotors. Wet rotor designs incorporate a rotor chamber filled with a compatible fluid to lubricate bearings and remove heat. The fluid must have good dielectric properties so that electrical conduction does not occur between the fluid and the motor windings.

There is, however, a disadvantage in the use of a fluid filled rotor chamber in that viscous drag due to the fluid properties will result in a decrease of the overall efficiency of the motor. This decrease in efficiency can become quite significant as the motor size increases.

Dry rotor designs have segregated motor and seal chambers whereby the motor rotor turns in a non wetted environment, or dry rotor chamber, reducing viscous drag and therefore increasing the overall efficiency of the motor. Dry rotor designs typically incorporate two mechanical seals, one located at each end of the seal chamber. The seal chamber is filled with a compatible fluid that serves to cool and lubricate the faces of the inboard seal separating the rotor chamber and the seal chamber. The outboard seal separating the seal chamber from the pumped fluid often relies on the pumped fluid for its cooling and lubrication.

When a submersible motor is immersed in fluid, pressure on the external surfaces of the motor increase proportionately with the depth of submergence—approximately one pound per square inch pressure for every 2.3' of submergence with water. It is a well-known fact that gasses and fluids will always tend to flow from areas of high pressure towards areas of low pressure. Although submersible pumps incorporate so called "mechanical" seals to prevent the ingress of fluid into the motor cavity or rotor chamber, these seals do not seal, but in actuality restrict the flow of fluid to very small levels. This fluid flow creates a hydrodynamic film on the mating seal faces that prevents overheating and premature wear.

Under normal circumstances a submersible motor always has fluid moving across the seal faces from the region of higher external pressure towards the region of lower pressure inside the motor. Manufacturers typically rely on some form of electronic moisture detectors located within the motor cavity to wam when conductive liquid has reached a level that poses a danger to the motor, or utilize stacked seals that slow the ingress of fluid sufficiently to provide a satisfactory motor life.

Past submersible designs have utilized some form of flexible device to keep the internal environment separate from but in communication with the external fluid so as to maintain a balance of pressure on the mechanical seals. These devices have taken the form of pistons, bellows, and bladders to name a few. All of these devices, although appropriate for clean environments, are unsuitable for operation in environments laden with grease, sludge, or solids that tend to defeat their movement ability.

Some designs have provided a non-submergible means for pressurizing the submergible motor through a connecting hose or the like. These reservoirs have typically been designed as separate support systems to the submersible motor and are not integral to the motor design.

U.S. Pat. No. 5,616,973, published Apr. 1, 1997, refers to a motor housing containing a plurality of integral cooling passages, through which buffer fluid is circulated by means of a co-axially mounted shaft driven vortex style impeller. The buffer fluid absorbs heat from the motor and transfers the heat into the pumped fluid via conductive heat transfer through a segregating partition that is common to both the buffer fluid and the pumped fluid. While effective at removing heat from a motor running in air, a disadvantage of this design is that, although the motor can run continuously in air, critical surfaces of the outboard mechanical seal, specifically the contacting rotating and stationary seal faces, that are subject to frictional heat build up, are located adjacent to a small annulus formed by the pump shaft and seal components, where little relative motion occurs between the buffer fluid and the critical seal surfaces.

European patent 939231A1, published Sep. 1, 1999, operates in a similar fashion utilizing an axial flow style of impeller. While effective at removing heat from a motor running in air, a disadvantage of these designs is that, although the motor can run continuously in air, critical surfaces of the outboard mechanical seal, specifically the contacting rotating and stationary seal faces, that are subject to frictional heat build up, are located adjacent to a small annulus formed by the pump shaft and seal components, wherein little relative motion occurs between the buffer fluid and the critical seal surfaces.

The buffer fluid in this stagnant zone does not provide sufficient cooling to the contacting faces of the outboard mechanical seal, which therefore must rely on the pumped fluid for cooling. In a run-dry condition where the pump has run out of fluid to pump and the motor continues to operate, or in a condition where a gas or vapor pocket surrounds the external surfaces of the outboard seal faces, overheating of the mating seal faces and subsequent premature failure of the outboard mechanical seal can occur. Therefore, the submersible motor is not capable of running for extended periods in any condition where the normally process wetted surfaces of the outboard seal faces are dry, without damage occurring to the mechanical seal faces due to heat build up. When used in a pumping application, this requires added instrumentation in the way of load sensors, level controls, and the like; or increased vigilance on the part of operators to avoid these problems. These options all have undesirable expense and reliability issues associated with them.

There have been disclosed submersible motor driven pumps with shaft seals that provide a sealing arrangement where the motor rotor chamber can be pressurized with gas from a remote source at a pressure higher than the surrounding fluid. This higher pressure is transferred into the seal chamber along the shaft thus preventing the ingress of the external fluid into the seal chamber from outside of the motor, and ingress of fluid into the motor chamber from the seal chamber.

There are, however, disadvantages in using a remote pressure source via the rotor chamber for pressurization. Mechanical seals do not 'seal', but in actuality 'restrict' flow. One disadvantage is that the seal life of this design is partially dependent on a small volume of buffer media within the seal chamber. There is no provision for supplementing buffer fluid to the seal chamber as it flows from the seal chamber to the external environment.

Another disadvantage of this design is that the volume of pressurized gas exceeds the available volume of buffer fluid to the degree that once the buffer fluid supply, within the seal chamber, is exhausted, gas will continue to pass across the seal faces. Although this will help prevent the ingress of external fluid across the seal faces, it will result in premature seal failure due to the fact that gas is not viscous enough to lubricate the seal faces of a mechanical face seal that has been designed for liquid lubrication.

Submersible motors are often oriented vertically, with the axis of the motor shaft more or less perpendicular with the earth's surface. Gas, being lighter than liquid, tends to rise to the highest point within any containment. A common problem with submersible units is that the mechanical seal faces are often located adjacent to the highest points within the pump chamber, for the outboard mechanical seal; and also adjacent to the highest points within the seal chamber, for the inboard mechanical seal. Any gas that is present in either the pump chamber, or the seal chamber, will tend to collect at the highest point within the chambers. If the gas pocket restricts the surrounding liquid from the seal faces, overheating and premature failure of a seal may result.

The most common form of submersible application is in water as is often found in wells. A less common but increasingly more common environment for submersibles is in industrial applications where abrasive media and/or chemicals may be the submergence media. In these environments, portability of the submersible motor is a desirable feature to many users. The use of remoted reservoirs or remoted pressurization sources restricts this portability. Also, in environments where solids are present, settling of the solids in and around the heat transfer surfaces of the motor restricts the motor's ability to transfer heat to the surrounding liquid. This results in premature motor failure.

Submersible motor driven pumps are often located in sumps, or other low areas where liquids collect, where the primary purpose is to transfer all of the collected liquid to another location. During normal operation, heat is generated within the motor due to electrical losses. This heat needs to be removed from the motor or it will build up and cause premature motor failure. Early submersible designs, relying on the superior heat transfer characteristics of fluids relative to gasses, required the motor to be submerged in liquid at all times. The primary disadvantage was that proper operation of the pump dictated that all of the liquid could not be removed from the pump site, thus defeating the primary purpose of the pump.

A number of inventions have successfully dealt with the issue of removing heat, from the motor, when the submersible motor becomes uncovered; allowing the submersible to pump the liquid down to a level below the motor. The most common designs rely on either pumping liquid through a annular chamber around the motor housing, or circulating buffer fluid, by means of a radial impeller within the seal chamber, through jackets within the motor housing, past cooling fins that transfer motor heat into the pumped fluid for cooling.

The disadvantage of these designs is that although the motor is now protected, the mechanical face seal that restricts leakage along the shaft, from the seal chamber to the external environment, relies on the pumped media for cooling. Therefore the submersible motor is not capable of operating completely dry, for extended periods, without damage. When in a pumping application this requires added instrumentation in the way of load sensors, level controls, and the like; or increased vigilance on the part of operators. These options all have undesirable expense and reliability issues associated with them.

Regardless of how well designed a piece of machinery is, all machines with moving contacting parts, are subject to wear, and require periodical preventive or repair maintenance. In an industrial environment, downtime for a piece of equipment such as a pump can often affect the overall productivity of a process, or environmental safety where effluents are involved. Submersible motors, as presently constructed, utilize shaft seals and bearings that are mounted as segregate components. Proper installation dictates the locating and fitting of these components individually, thereby prolonging the time required for assembly and disassembly.

SUMMARY OF THE INVENTION

It is an object the invention to provide a sealing arrangement for electric motor driven submersible pumps that overcomes the disadvantages noted in the prior art.

A particular object of this invention is to provide a net positive pressure in the seal chamber, relative to the external fluid, where the ingress of the external fluid between the seal faces, due to solids and other contaminants contained in the external fluid, would tend to reduce seal or motor life relative to the life obtainable with a clean, compatible, fluid between the seal faces.

Another object is to provide an environment whereby the submersible motor is able to operate dry for an extended time period, that is, to say without any contact with an external liquid for cooling purposes and without damage to the seal or motor.

A further object is to provide an environment whereby the submersible motor is able to operate dry for an extended time period, without damage to the seal or motor, regardless of the rotational direction of the motor.

Yet another object is to provide an environment, where gas that might collect, within the pump chamber, adjacent to the mating faces of the outboard mechanical seal, that will not result in dry running and resultant overheating of the mechanical seal.

Another object is to provide a seal and bearing arrangement that allows for decreased installation and removal time for the seal and bearing arrangements, as compared to that provided by present submersible designs Another object is to provide for the above, in an environment where the external motor surfaces are exposed to liquids carrying solids and other contaminants, in such a way so as to allow the surrounding environment to carry away the heat generated by the motor without creating restrictions that might cause the solids, or contaminants, to build up, inhibiting heat transfer.

Another object is to allow for pressurization of the seal chamber with a dry rotor design so as to allow for greater operating efficiencies than provided by wet rotor designs.

Another object is to provide for portability of the equipment by providing a motor pressurization system that would form an integral part of the submersible assembly.

Another object is to allow for pressurization of the seal chamber with a dry rotor design while at the same time providing an integral reservoir to replenish the buffer medial lost during normal operation.

Other objects and advantages of the present invention will become readily apparent to those skilled in this art from the following detailed description, wherein we have shown and described only a preferred embodiment of the invention, simply by way of illustration of the best mode contemplated by us on carrying out our invention.

DESCRIPTION OF THE PREFERRED EMBODIMENT

There are three principle elements or features of the preferred embodiment of a submersible, motor-driven pump. There is an integrally mounted pressurization reservoir used in combination with a submersible motor of the dry rotor type to maintain pressure in the seal chamber at a level higher than that found in the external environment at the working depth of the pump. The submersible motor incorporates a removable shaft sleeve or cartridge-mounted lower bearing and upper seal assembly, which facilitates installation and removal of both components, with the bearing located between the inboard and outboard mechanical seals. Mounted onto this removable sleeve is a unique circulating impeller that, in addition to imparting centrifugal pumping action for the purposes of motor cooling, converts kinetic energy into fluid flow that simultaneously circulates liquid along the motor shaft for cooling the shaft seals, thereby allowing the motor to run dry for extended time periods.

These features, which can be applied either separately or in combination, are delineated as: (1) a pressurization reservoir, integrally mounted with and segregated from a submersible motor; (2) a combination centrifugal and pitot tube impeller for both local and motor cooling circulation of a buffer fluid; and (3) a lower bearing and upper seal assembly cartridge mounted on the motor shaft such that the lower bearing is located between the upper and lower mechanical seals, and which will also accommodate the buffer fluid impeller, where used.

Figure 1:
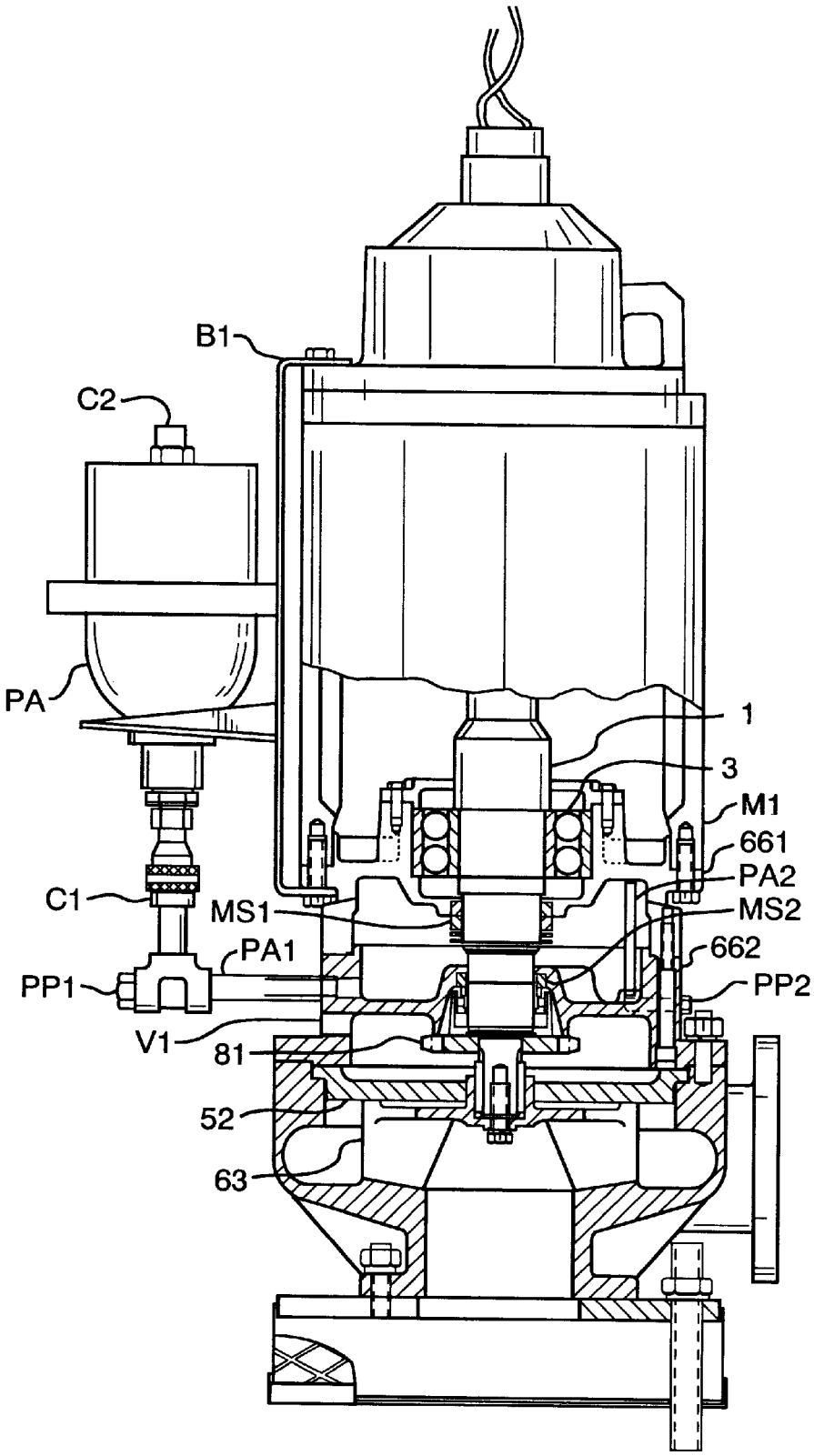
FIG. 1 is a combination section and diagrammatic view of a preferred embodiment of the invention, an submersible electric motor and pump assembly that incorporates an integral seal pressurization device that serves as a storage reservoir and accumulator for the motor seal chamber.

Reference is first made to a portion of the structure shown in FIG. 1. An outer shell 661, attached either integrally or mechanically with the motor and pump assembly M1, is fitted with an outer cover 662. A shaft 1 extends from the enclosed motor through an annulus in the outer shell 661 and another annulus in the outer cover 662. Mechanical seals MS1 mounted concentrically in the outer shell 661, referred to herein as the inboard seal, and mechanical seal MS2 mounted concentrically in the outer cover 662, referred to herein as the outboard seal, restrict leakage of fluid along the shaft 1. The assembly of the outer shell 661, the outer cover 662, the mechanical seals MS1 and MS2, and the shaft 1, form what will herein be referred to as the seal chamber.

There exist many commercially available mechanical face seal designs which are proven for use in restricting flow of fluid, from high pressure areas, to low pressure areas in rotating equipment. This invention is not dependent on the particulars of the mechanical face seal utilized, but instead focuses on creating a more favorable environment in which the mechanical face seal can operate.

The seal chamber serves to house the mechanical seals and to serve as a reservoir for a protective fluid that serves to cool and lubricate the seal faces. This fluid is commonly referred to as the buffer fluid. The buffer fluid can be any clean non-corrosive fluid having both lubricant and dielectric properties sufficient to prevent shorting of the motor windings and to lubricate the seal faces. Various commercially available oils or oil like substances have been found suitable as liquid buffer fluid.

Figure 2:
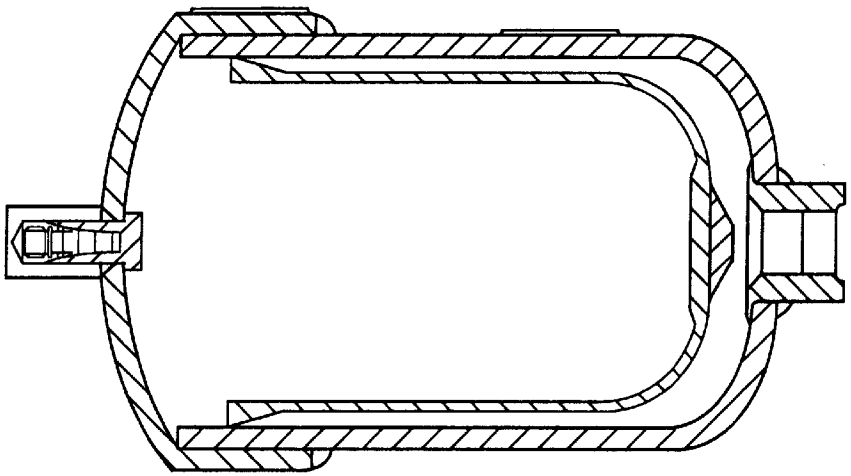
PRIOR ART FIG. 2
FIG. 2 is a section view of the bladder type pressure accumulator of FIG. 1.

A pressurized reservoir PA serves as a reservoir and a pressurization source for the seal chamber. Prior art FIG. 2 depicts a typical commercially available pressurization reservoir of the gas-operated type, as is used in the embodiment of FIG. 1. The type of reservoir is not as critical as its functionality. First, it must be able to transmit pressure from a mechanical device such as a piston or a spring, from gas pressure, or from a combination mechanical/gas operated device. It must be able to transmit pressure to the buffer fluid in the seal chamber.

If it is of a gas operated type, it should provide segregation of the gas and the buffer fluid so that gas under pressure is not absorbed by the buffer fluid and released as it passes across the seal mating faces, where it might cause premature seal damage. It should have a design pressure rating suitable to provide for a buffer fluid pressure equal to, or greater than, the pressure on the process side of the seal face at the moment when the pressurized reservoir PA has exhausted its normal fluid capacity. Although this is not an absolute requirement, providing a positive pressure gradient across the outer seal as long as possible will maximize a key benefit of using a pressure reservoir, irrespective of capacity.

Referring back to FIG. 1, the pressurization reservoir PA is connected, via conduit PA1 through which fluid can flow bi-directionally, to the seal chamber. In this particular case a quick disconnect fitting C1 is used to facilitate installation and removal. Other forms of connections could be used without taking away from the object of the invention. The pressurization reservoir PA is rigidly attached to the submersible motor and pump assembly M1 by bracket B1 such that the motor and pump assembly is free and open to the external environment, and the entire assembly of the submersible motor and pump assembly M1 and the pressurization reservoir PA are portable as a singular unit.

It will be readily apparent that the pressure reservoir can be otherwise integrated into the overall motor design, such as being vertically stacked over the motor, or be a circumferential tank disposed around the motor at the level of the seal chamber, with suitable diaphragm, fittings and connections to the seal chamber, or even be internal to the motor or pump housing, so long as its configuration does not interfere with or otherwise detract from the other necessary functions and minimum cooling capacity of the overall design.

Prior to installation on the submersible motor assembly, the pressurization reservoir PA is pressurized mechanically, or in this case, with gas via a capped unidirectional valve C2, to a pressure higher than the anticipated maximum submergence pressure. The buffer fluid seal chamber and connecting lines into the pressurization reservoir PA are then charged or filled with buffer fluid from a pressurized source, via the quick disconnect fitting C1, to the maximum normal pressure of the seal chamber design, which includes consideration of the inboard and outboard shaft seal designs. If the reservoir is integral to the housing or not otherwise easily removable, it can be filled and charged on the motor assembly. It will be appreciated that for some configurations, the arrangement and order of fill might differ, but the end result is a self contained, pressurized, buffer fluid seal chamber.

Typical safety margins for calculating maximum normal pressure may be in the order of two thirds (⅔) the design pressure of the pressure assembly at maximum operating temperature, or two thirds (⅔) the design pressure of the assembly dependent component with the lowest design pressure rating at rated temperature, which ever has the lowest design pressure rating. The applicants make no claim as to what constitutes an adequate safety margin in third party designs.

Assembly dependent components in this embodiment are defined as the pressurization accumulator PA, the interconnecting piping, components PA1, PP1, C1, the outer cover 662, the outer shell 661, mechanical seals MS1 and MS2, and the motor M1. The Pressure assembly is defined as the assembly of the assembly dependent components. Vent plug PP2 is removed and the seal chamber is filled with buffer fluid via piping PA1.

During filling air will vent from the seal chamber via vent pipe PA2. When buffer fluid is observed exiting the seal chamber via the vent PA2, filling will stop, and vent plug PP2 will be replaced. The filled and pressurized reservoir PA is then assembled onto the submersible motor assembly by assembling quick disconnect fitting C1 with the interconnecting piping PA1, bracket B1 with motor M1, and bracket B1 with pressurization reservoir PA.

As the submersible motor pump assembly operates, flow of buffer fluid will be from the higher pressure seal chamber past the seal faces of the outboard seal MS2, into the external process environment. Leakage will also occur across the seal faces of the inboard seal MS1, into the motor chamber. Because of its dielectric properties the buffer fluid entering the motor chamber M1 will do no harm. As buffer fluid passes from the seal chamber, the pressurization reservoir PA will supplement additional buffer fluid until such time as it is necessary to refill and recharge the pressurization accumulator PA.

As the submersible motor pump assembly operates; the temperature within the seal chamber will tend to rise. This is due to heat generated by electrical and mechanical losses with the motor M1, and due to frictional heat developed by the mechanical seals. The Bi-directional flow capability of the pressurization reservoir PA will allow for buffer fluid expansion when the motor temperature rises, and buffer fluid contraction during cool down, without seal damage.

Submersible motors are often oriented vertically, with the axis of the motor shaft more or less perpendicular with the earth's surface. Gas, being lighter than liquid, tends to rise to the highest point within any containment. Any gas that is present in either the pump chamber, or the seal chamber, will tend to collect at the highest point within the chambers. The outer shell 661 is designed such that any gas in the vicinity of the mating seal faces of the inboard seal MS1, taking advantage of a gas's natural tendency to rise in liquid, will move upwards and radially away from the seal faces, collecting in the area where vent pipe PA2 resides. Because gas is vented away during the initial filling, the seal chamber surfaces of both the inboard seal MS1 and the outboard seal MS2, will be submerged during operation. The seal chamber, pressurized at a higher pressure than the surrounding environment, will ensure that gas external to the seal chamber does not enter.

All centrifugal pumps are designed with clearances separating rotating from stationary components. One such clearance exists and forms an annulus between the rotating hub of a pump impeller 63, and the stationary back plate 52. Solids, sludge, or other contaminants, residing in the pumpage, will tend to flow, due to a pressure differential that exists on either side of the back plate 52, through the annulus formed by the rotating pump impeller 63, and the stationary back-plate 52, into an area, henceforth referred to as the secondary pump chamber, that is bounded by the outer cover 662, the outboard seal MS2, the shaft 1, and the backplate 52.

Liquid entering the secondary pump chamber will tend to flow out port V1 back into the surrounding environment. The process wetted side of the outer cover 662, that is adjacent to the mechanical seal assembly MS2, forms a concentric inverted cup shaped tapered annulus relative to the adjacent mechanical seal assembly MS2, whereby the smaller diameter of the taper is adjacent to the seal faces, and the larger diameter of the taper terminates some axial distance away from the seal faces within the secondary pump chamber.

Fluid entering the annulus is accelerated in a rotational fashion about the axis of the shaft 1 though frictional drag, as well as kinetic forces that are imparted by the rotational surfaces of the shaft 1, slinger 81, and the rotary elements of the outboard seal MS2. Centrifugal forces acting on the rotating mass of liquid within the annulus will cause fluid to move along the tapered surface of the outer cover 662 in the direction of the larger diameter end of the tapered surface which terminates within the secondary pump chamber. This flow helps to prevent any solids from settling out on, and potentially restricting the movement of, the components of the outboard mechanical seal MS2.

As has been pointed out herein before, the submersible motor is generally assumed to be a motor surrounded by fluid that is restricted from access to the interior of the motor. Thus, while in the previous embodiment, the external surface of the motor and pump assembly M1 is actually immersed in and receives cooling from the pumped media, the embodiment of FIG. 3 is directed to a motor which may not be submersed in the pumped media, nor will it receive any coolant benefit from any external liquid during extended periods of operation.

Figure 3:
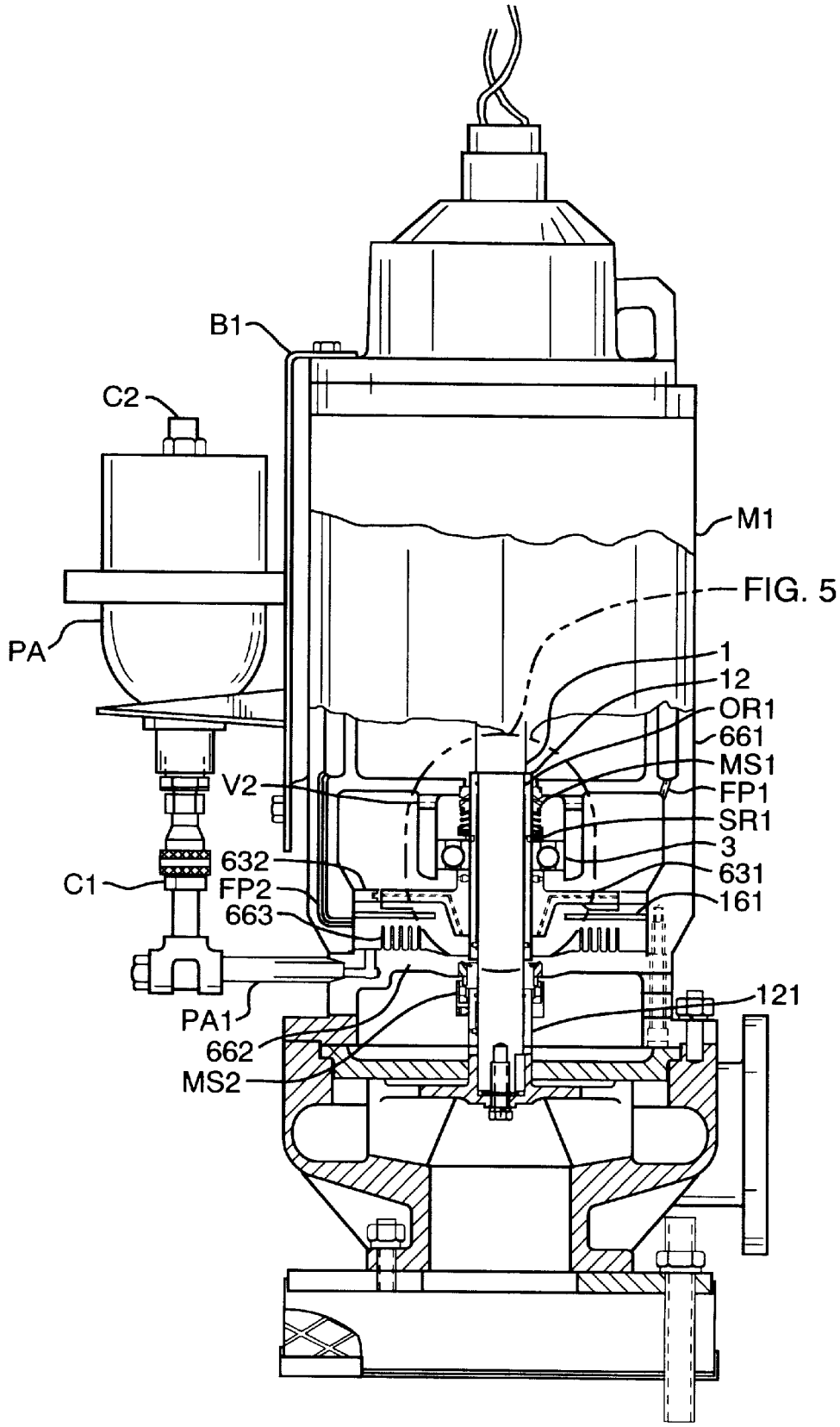
FIG. 3 is a partial sectional view of another preferred embodiment of the invention, a submersible motor with an internal impeller to circulate a buffer liquid for cooling of the motor and the bearing and seal cartridge assembly , and for circulation of buffer fluid and cooling of the mechanical seal within the annulus formed by the outboard mechanical seal and the motor shaft.

The novel impeller design of FIG. 3, in addition to circulating buffer fluid for the purposes of motor cooling, is capable of simultaneously directing coolant to the critical surfaces of the outboard mechanical seal, thereby enabling continuous run dry operation. This unique impeller design may be used separately or in conjunction with the buffer fluid pressurization system of FIG. 1.

Referring now to FIG. 3, a motor and pump assembly M1 is designed with fluid passages that emanate from and return to the seal chamber formed by the assembly of the outer shell 661, outer cover 662, enclosed motor, shaft 1, inboard mechanical seal MS1, outboard mechanical seal MS2, shaft sleeve 12, and shaft sleeve 121. Shaft sleeve 12 and shaft sleeve 121 are an optional, further enhancement of the invention, discussed at greater length hereafter, the presence or absence of which do not affect the function or utility of this immediate feature.

In keeping with previous developments of the art, buffer fluid is accelerated by means of a plurality of equally spaced radial vanes located concentrically disposed about the periphery of an impeller 631, rigidly mounted on a shaft 1, or sleeve 12, some portion of the buffer fluid discharging into a passage located on the upper side of baffle 161, and through fluid port FP1, which is in direct communication with the fluid passages within the motor and pump assembly M1, absorbing heat that is generated by frictional and electrical losses within the motor, and some portion discharging to circulate within the open areas of the seal chamber itself.

Figure 4A:
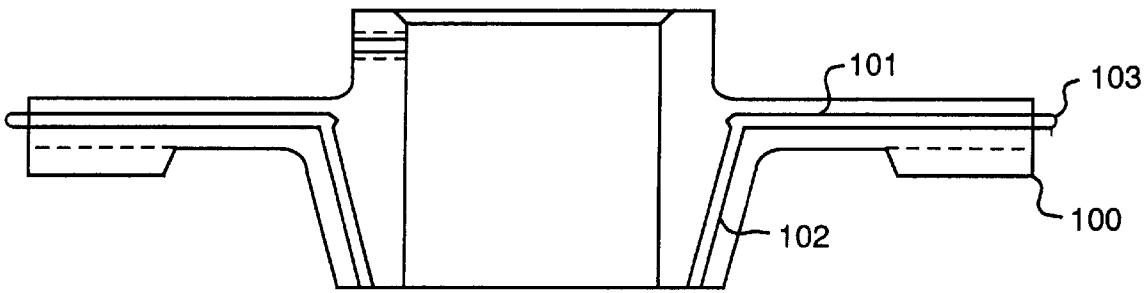
FIGS. 4A and 4B depict details of the impeller design referred to in FIG. 3.
Figure 4B:
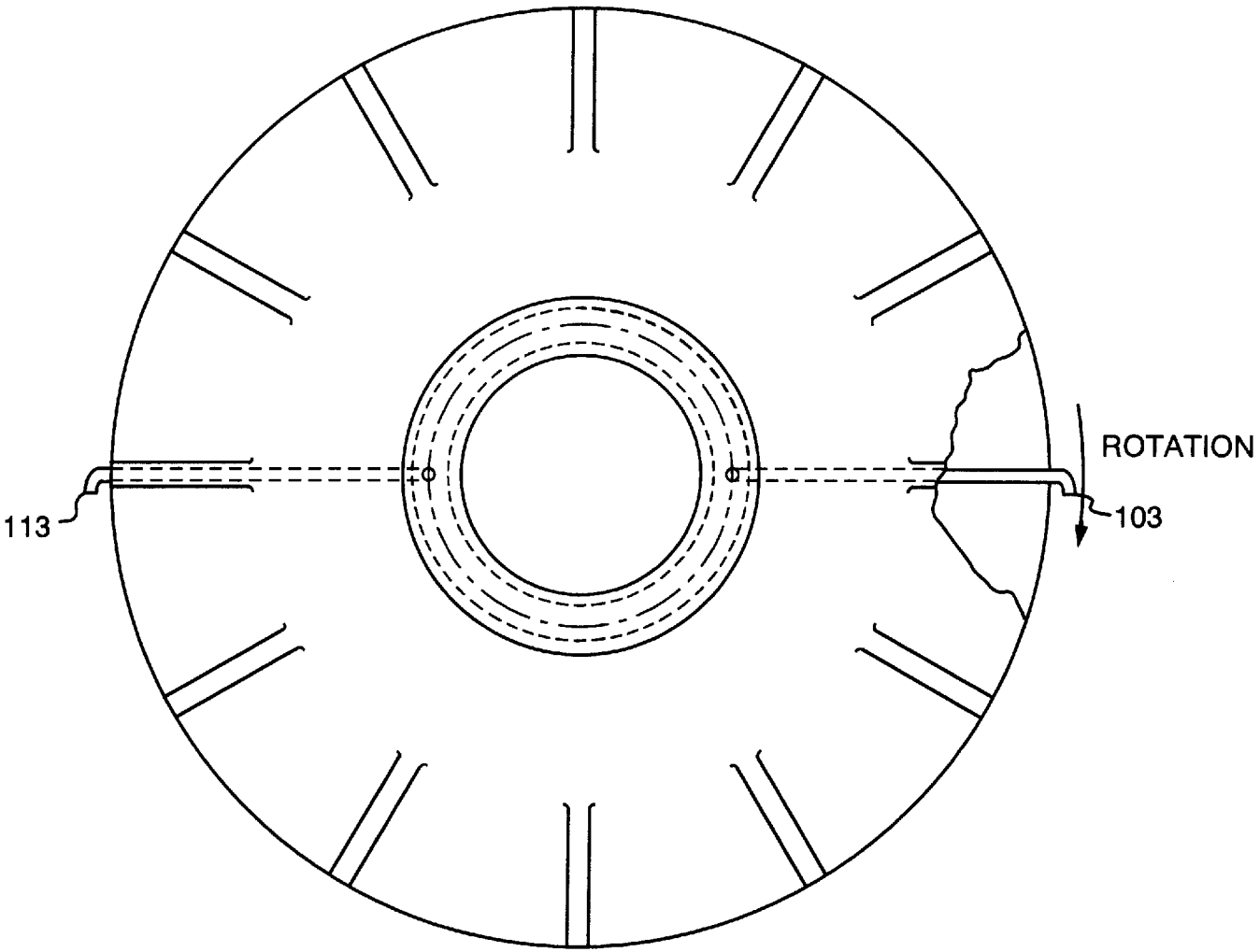

A plurality of stator vanes 632, radiating inward from the internal surface of outer shell 661, serve to partially disrupt the buffer fluid's tendency to rotate with the impeller 631, thereby maintaining a relative velocity differential between the impeller 632 and the buffer fluid in the immediate vicinity of the pick-up tube 103 of impeller 632, illustrated more clearly in FIGS. 4A and 4B.

Still referring to FIG. 3, buffer fluid returns to the seal chamber from fluid passages within the motor M1 via a fluid passage that is in communication with the seal chamber, located on the underside of baffle 161, at fluid port FP2, where it is drawn across heat exchanging fins 663 that extend into the seal chamber perpendicular to outer cover 662. As buffer fluid is drawn across fins 663, excess heat is transferred through the fins to outer cover 662, and absorbed by the external fluid or air in the seal chamber within outer cover 662. Buffer fluid is then drawn through an annulus formed by an opening in baffle 161 and the hub of impeller 631, where it is again accelerated by the impeller 631 and repeats the cooling cycle.

Referring now to FIGS. 4A and 4B, the impeller detail of impeller 631 of FIG. 3 is more clearly disclosed. In a significant departure from the prior art, impeller 631, possesses, in addition to a plurality of vanes 100 equally spaced about a central axis for the purpose of accelerating fluid radially outward, at least one internal radial passage 101, extending from the outside diameter of impeller 631, inwardly towards the hub of the impeller. A secondary passage 102, the axis of which intersects the central longitudinal axis of the impeller 631, some designated distance away from the impeller, originates at an intersection with primary passage 101, and terminates at the face of the hub of impeller 631. A right angle pick-up tube 103 is connected to radial passage 101, mounted at the periphery of the impeller 631 and oriented with its open end facing in the direction of rotation of impeller 631.

Circulating impeller types are described, and distinguished in part, as will be understood by those skilled in the art, by the specific speed of the impeller, which is a dimensionless number that characterizes the performance of an impeller in relation to its design geometry. The geometry and speed of rotation are factors in the performance of pick up tube 103.

During operation, pick up tube 103 will collect a portion of the buffer fluid as impeller 631 turns in the buffer fluid. The collected fluid will experience a net velocity head, over and above the pressure generated by the centrifugal action of the impeller, proportional to the square of the speed difference between the impeller and the rotational velocity of the fluid mass at the periphery of the impeller. The kinetic energy of the liquid in the pick up tube is converted to a static pressure over and above the pressure differential that exists due to centrifugal action between the periphery and the inlet of the impeller.

A pressure differential therefore exists between the periphery of the impeller and the inlet, which creates a resultant velocity along the radial passage 101. The pressure differential created by the centrifugal forces of the radial vanes 100 are canceled out by those same forces as it attempts to return via the radial passage 101. A net fluid velocity results in the radial passage 101, traveling from the periphery towards the impeller inlet, resulting from the pressure generated within the pick-up tube 103 due to kinetic conversion minus frictional and turbulence losses within radial tube 101.

The fluid then enters the secondary passage 102, and is discharged into the annulus between the outboard seal MS2 components and shaft sleeve 12 or sleeve 121, as shown in FIG. 3. This discharge displaces fluid within the annulus resulting in relative motion between the seal face components and the buffer fluid, helping to reduce or eliminate hot spots, and generally cooling the seal faces. In this manner, cooling of the seal faces can continue even though the pump has run dry and external fluid circulation has ceased.

Referring again to FIGS. 4A and 4B, this aspect of the invention can be further enhanced by duplicating the internal passage arrangement elsewhere on the impeller, such as 180 degrees offset from the first arrangement, and providing a right angle tube 113 oriented with its open end facing in a direction opposite that of normal rotation of impeller 631. This will enable lubrication of the seal faces to continue in the event of reverse rotation of the motor rotor. An added benefit is realized from this arrangement in the way of increased circulation in the vicinity of the lower seal. In addition to the pumping action relating to tube 103, the opposite facing tube 113, and its associated passages, provide a centrifugal out-pumping action during operation that results in a net discharge of fluid from tube 113, thereby increasing the circulation and flow of buffer fluid in the area around the impeller hub adjacent to pump shaft 1.

In other words, the pick up tube that is facing into the direction of rotation will undergo a kinetic conversion that directs flow from the periphery of the impeller 631, inwardly towards the impeller hub. The pick up tube that is facing away from the direction of rotation will create flow, through centrifugal action, from the impeller hub outwardly towards the periphery of the impeller, thus resulting in a circulation loop. This phenomenon is independent of rotational direction, and can be multiplied with additional sets of passageways and alternately facing pickup tubes, preferably uniformly spaced and alternating about the impeller.

This novel impeller-enhanced circulation flow can be applied to any rotating, fluid circulating impeller, for promoting buffer fluid circulation near a shaft seal face abutting the hub of the impeller on either or both sides of the impeller. Variations in the geometry of the passageways and pickup tubes that accomplish substantially the same circulation loop between impeller periphery and hub or shaft regions of fluid are within the scope of the invention.

In another embodiment of the invention, the motor bearing closest to the pump is moved into the seal chamber, shortening the overhung distance between the bearing and the driven load. As is known in the art, moving the load end bearing from above the inboard mechanical seal to a location between the inboard and outboard mechanical seals has the effect of reducing shaft deflections at the outboard seal face, due to the reduced cantilevered distance between the bearing and the seal, thereby improving seal effectiveness and extending seal life. Most bearings in dry rotor motor designs are grease lubricated, so further advantage is realized by this bearing placement; by moving the bearing from the grease lubricated environment of the motor rotor chamber into the oil lubricated environment of the seal chamber. For any given load and speed, an oil lubricated bearing will run cooler and have a greater theoretical life than a grease lubricated bearing. This bearing placement has yet a further advantage according to the invention, as is explained below.

It is readily apparent and has been mentioned herein, that rotating equipment does, from time to time, require maintenance. Although the primary object of the embodiments described herein is to prolong the operating life of the equipment, another objective is to improve the ease of maintenance and reduce the downtime to perform maintenance. When maintenance is required, it often involves disassembly of the seals and bearings from the motor assembly, either for replacement, or for inspection. Therefore a design that allows the user to remove and install bearing, seals, and other rotating components on a single pre-assembled sleeve, which may be referred to here as a cartridge assembly, will be of value to the user.

Referring again to FIG. 3, the non-rotating portion of the inboard mechanical seal MS1 is mounted on the outer shell 661, which can be an integral, or a separate part of motor M1. A cartridge assembly is made up of the rotating elements such as the rotating portion of the inboard mechanical seal MS1, outboard bearing 3, and the circulating impeller for buffer fluid circulation, impeller 631, the elements being used either singularly or in combination. The cartridge assembly is designed such that it can be pre-assembled, and easily positioned at a predetermined location on the shaft sleeve 12, which is rigidly mounted co-axially with shaft 1, so that all components rotate with the shaft.

In FIG. 3, pre-positioning of shaft sleeve 12 is accomplished by the abutment of shaft sleeve 12 against a machined shoulder on shaft 1. There are a number of standard machine design methods utilized in positioning rotating elements along shafts. This particular method is shown by way of example. The actual method used in no way detracts from the scope of this invention. When the sleeve 12 is properly positioned on shaft 1, the rotating element of the inboard mechanical seal MS1 will engage the stationary element of the inboard mechanical seal MS1, that is mounted in the outer shell 661, with the proper compression.

Bearing 3 will engage an inverted, cup-shaped bore in outer shell 661, herein known as the bearing housing, formed integrally with and concentric to outer shell 661. A plurality of passages V2 are machined at the highest point of the bearing housing, normal to its longitudinal axis, such that buffer fluid will freely circulate around bearing 3, the inboard mechanical seal MS1, and the seal chamber. Any air or gas trapped in the seal chamber will be able to freely move through these passages, away from the inboard mechanical seal MS1. Other components, such as circulating impeller 631, can be mounted coaxially on shaft sleeve 12, which, in turn, is mounted co-axially with shaft 1, such that the entire sub-assembly can be quickly installed and removed from submersible motor assembly M1. An O-ring OR1 forms a seal to prevent leakage between the inside diameter of shaft sleeve 12 and the outside diameter of the shaft 1.

The type, number, and geometry of various cartridge elements may vary with design and application. This embodiment utilizes a seal, a bearing, and a circulating impeller, by way of example only. Other types and combinations of cartridge elements can be used without detracting from the unique application of cartridge assemblies and shaft sleeves in the design and maintenance of submersible motors.

Figure 5:
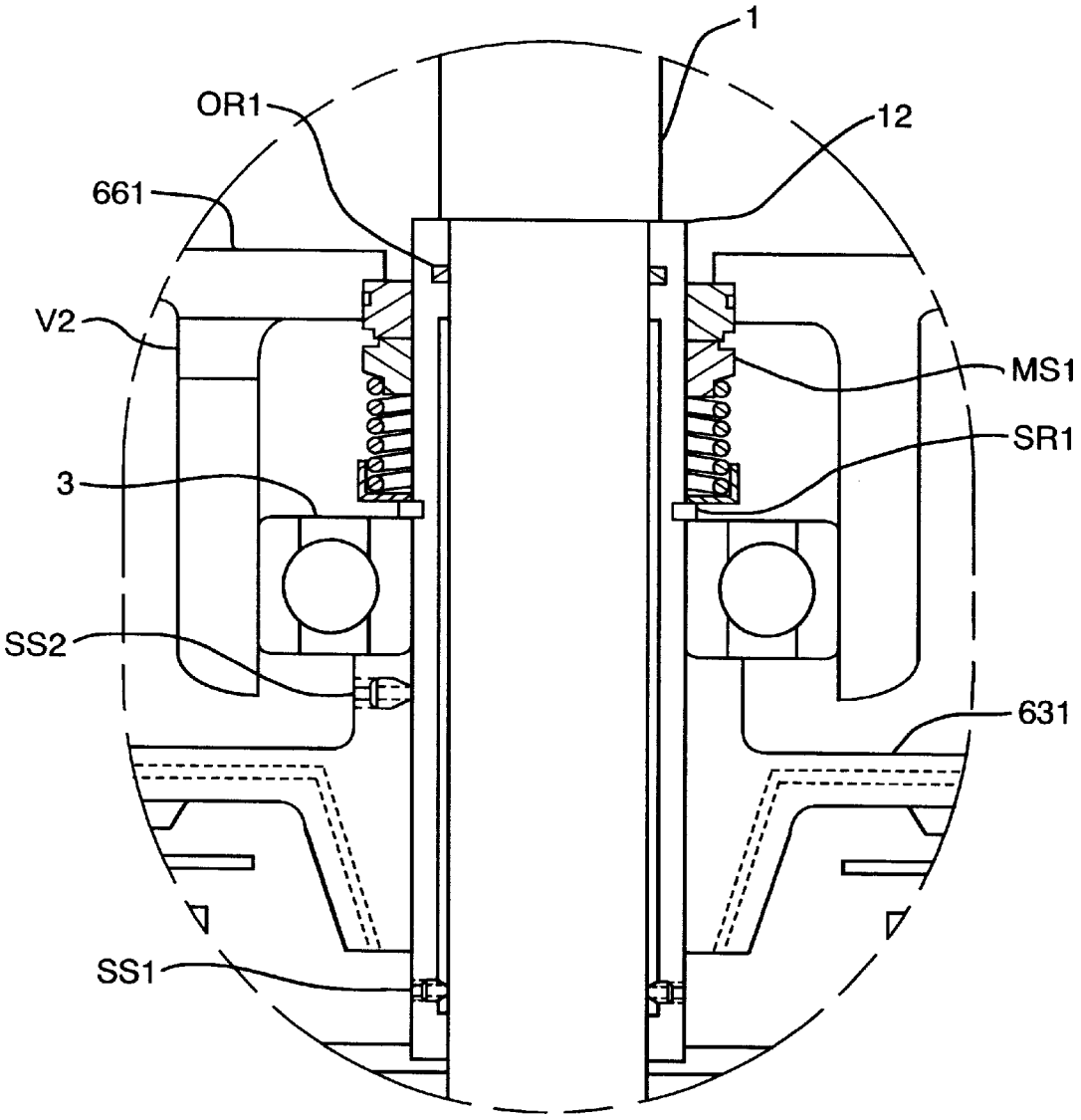
FIG. 5 is a partial sectional view of mechanical face seal and bearing arrangement that allows for rapid change out of the seals and bearing, while reducing shaft deflection, at the seal faces, due to radial loads, and reducing the overall radial loads on the inboard bearing.

Referring specifically to FIG. 5, an enlarged view of the dotted line region of FIG. 3 provides more detail. For the assembly of the cartridge unit described above, there is a groove, machined concentrically in the outside diameter of shaft sleeve 12, such that it forms a plane perpendicular with, and at a known distance along, the longitudinal axis of sleeve 12. Snap ring SR1 is assembled into this groove, the location of which will dictate the axial positioning of the remaining cartridge components. The rotating element of the inboard mechanical seal MS1 is assembled coaxially onto sleeve 12 such that it abuts snap ring SR1. Bearing 3 is mounted coaxially on sleeve 12 such that its rotating inner race abuts the opposite side of the snap ring SR1. Buffer fluid circulating impeller 631 is mounted coaxially on shaft sleeve 12 such that it abuts the opposite side of the inner race of the bearing 3. The sleeve and the elements mounted on the sleeve are rotated by the shaft when the motor is running.

There are a number of design practices that can be utilized in positioning rotary elements along sleeves. The sleeve groove and snap ring SR1 is shown simply by way of example. The actual method used in no way detracts from the scope of the invention.

The invention is susceptible of many embodiments. For example, the seal chamber pressurization and pressure reservoir enhancement can be extended to providing a motor chamber pressurization system with its own buffer fluid supply and pressure reservoir, maintained at a higher pressure than the seal chamber so that the net leakage of buffer fluid is always outward through the shaft seals, from motor chamber to seal chamber to pump. Alternatively, the seal chamber pressurization and pressure reservoir enhancement can be extended to provide a pressurization system to additional mechanical seals that may be added for additional sealing protection, each with its own pressure reservoir, maintained at a higher pressure than the external environment, such that any single seal might fail without permitting the pumped fluid to gain access to the primary seal chamber.

Although the prior art shows a strong preference for a vertical orientation of motor over pump and vertical shaft, the invention applies to and facilitates use of horizontal shaft submersible pumps where appropriate.

As another example, there is within the scope of the invention, a submersible motor and pump assembly consisting of a motor and motor housing, the motor having an output shaft, and a pump and pump housing, the pump housing being connected to the motor housing and the pump being driven by the output shaft. There is a removable shaft sleeve non-rotatably mounted on the shaft. There is an inboard shaft seal proximate the motor, with the rotary component of the inboard shaft seal mounted on the sleeve. There is an outboard shaft seal proximate the pump, and a seal chamber interspersed between the motor and the pump, where the seal chamber consists, in part, of the chamber side faces of the inboard shaft seal and the outboard shaft seal.

The seal chamber charged with a buffer fluid under pressure at least equal to the pressure external of the motor and pump assembly at the working depth of the pump, and the buffer fluid has dielectric properties. There is a seal chamber pressurization system and at least one pressure reservoir integral to the motor and pump assembly for maintaining a positive pressure gradient within the seal chamber across the shaft seals.

There may be a buffer fluid circulation impeller with a periphery and a hub, the periphery being of significantly larger diameter than the hub, where the impeller is mounted on the sleeve within the seal chamber proximate the outboard shaft seal or some other seal or adjacent component needing additional lubrication or cooling. The impeller has at least one internal passageway connecting a rotationally normally forward facing intake tube on the outer edge or periphery of the impeller, to a discharge port on the hub of the impeller proximate the outboard shaft seal, the hub being of smaller diameter than the periphery. The seal chambers within which the impellers rotate, may have radially oriented stator flanges outboard of the impeller, that are oriented so as to have one edge closely adjacent the arc of rotation of the intake tubes on the impeller.

As yet another example, embodiments of the invention may include a submersible motor and pump assembly with an externally mounted or integral pressure reservoir communicating with the seal chamber so as to maintain a positive pressure gradient during pump operations, where the seal chamber pressurization system has a capacity for buffer fluid in excess of the volume of fluid calculated to be lost due to leakage through the shaft seals during a period of normal operation of the motor and pump assembly.

Other embodiments of the invention may include a submersible motor and pump assembly with a multiplicity of pressure reservoirs connected to the seal chamber pressurization system so as to effectively enlarge the pressure reservoir capacity, such as to serve a larger buffer fluid supply, providing a potentially longer operational cycle.

Yet other embodiments may have a seal chamber where the interior surface or ceiling extends upwardly away from the inboard shaft seal, thereby providing a limited volume within the seal chamber for containing gas that may be trapped or accumulated in the seal chamber, at above the height of the inboard shaft seal, so that the seal stays emerged in buffer fluid.

Further embodiments may have impellers with at least one internal passageway connecting a rotationally normally rearward facing discharge port on the periphery to a hub intake port on the hub, thus providing a return path for fluid circulation between the hub and periphery regions of the impeller.

Some embodiments may include integral pressure, fluid level, or temperature sensors, in combination with shut-off controls of various kinds. Some may include signal lines to the surface for monitoring by an operator. The scope and nature of these sensor and control systems is well understood to those skilled in the art, and can be readily adapted to invention. For example, there may be pressure sensors for seal chamber pressure or pressure differential, coupled to automatic motor shut-off controls for deactivating the pump when the pressure in the seal chamber falls below the pressure external of the motor and pump assembly at working depth. This assures in particular that there is a positive pressure gradient across the outboard shaft seal at all times that inhibits the ingress of any pumped media or fluid.

Other and various embodiments within the scope of the invention will be readily apparent to those skilled in the art, based on the preceding description, appended drawings and the claims that follow.

Among our claims are:

1. A submersible motor and pump assembly comprising a motor and motor housing, said motor having an output shaft, a pump and pump housing, said pump housing connected to said motor housing, said pump being driven by said output shaft, a removable shaft sleeve mounted on said shaft, an inboard shaft seal proximate said motor, the rotating components of said inboard shaft seal mounted on said sleeve, an outboard shaft seal proximate said pump, a seal chamber interspersed between said motor and said pump, said seal chamber comprising in part the chamber side faces of said inboard shaft seal and said outboard shaft seal, said seal chamber charged with a buffer fluid under pressure at least equal to the pressure external of said motor and pump assembly at working depth, said buffer fluid having dielectric properties, a seal chamber pressurization system and at least one pressure reservoir integral to said motor and pump assembly for maintaining a positive pressure gradient within said seal chamber across said shaft seals, a buffer fluid circulation impeller mounted on said sleeve within said seal chamber proximate said outboard shaft seal, said impeller having at least one internal passageway connecting a rotationally normally forward facing intake tube on the periphery of said impeller to a discharge port on the hub of said impeller proximate said outboard shaft seal, and a multiplicity of radially oriented stator flanges in said seal chamber outboard of said impeller, one edge of said flanges being closely adjacent the arc of rotation of said intake tube.

2. A submersible motor and pump assembly according to claim 1, said pressure reservoir communicating with said seal chamber so as to maintain said positive pressure gradient during said operation, said integral seal chamber pressurization system comprising a capacity for buffer fluid in excess of such volume as is calculated to be lost due to leakage through said shaft seals during a period of normal operation of said motor and pump assembly.

3. A submersible motor and pump assembly according to claim 1, said at least one pressure reservoir being a multiplicity of pressure reservoirs connected to said seal chamber pressurization system.

4. A submersible motor and pump assembly according to claim 1, the interior surface of said seal chamber extending upwardly away from said inboard shaft seal, thereby providing a limited volume within said seal chamber for containing gas above the height of said inboard shaft seal.

5. A submersible motor and pump assembly according to claim 1, further comprising motor cooling passageways in said motor housing, said motor cooling passageways communicating with said seal chamber, said impeller providing pressure for flowing said buffer fluid therein.

6. A submersible motor and pump assembly according to claim 1, said impeller further comprising at least one said internal passageway connecting a rotationally normally rearward facing discharge port on said periphery to a hub intake port on said hub.

7. A submersible motor and pump assembly according to claim 1, further comprising means for sensing pressure in said seal chamber, means for sensing said pressure external of said motor and pump assembly at working depth, and means for deactivating said motor when said pressure in said seal chamber falls below said pressure external of said motor and pump assembly at working depth.

8. A submersible motor and pump assembly comprising a motor and motor housing, said motor having an output shaft, a pump and pump housing, said pump housing connected to said motor housing, said pump being driven by said output shaft, an inboard shaft seal on said shaft proximate said motor, an outboard shaft seal on said shaft proximate said pump, a seal chamber interspersed between said motor and said pump, said seal chamber comprising in part the chamber side faces of said inboard shaft seal and said outboard shaft seal, said seal chamber charged with a buffer fluid under pressure at least equal to the pressure external of said motor and pump assembly, said buffer fluid having dielectric properties, a seal chamber pressurization system and at least one independent pressure reservoir integral to said motor and pump assembly wherein said pressurization system maintains a continuous positive pressure gradient within said seal chamber across said shaft seals.

9. A submersible motor and pump assembly according to claim 8, said integral seal chamber pressurization system comprising a capacity for buffer fluid in excess of such volume as is calculated to be lost due to leakage through said shaft seals during a period of normal operation of said motor and pump assembly, said pressure reservoir communicating with said seal chamber so as to continuously maintain said positive pressure gradient.

10. A submersible motor and pump assembly according to claim 9, said at least one pressure reservoir being a multiplicity of pressure reservoirs connected to said seal chamber pressurization system.

11. A submersible motor and pump assembly according to claim 9, an inner surface of said seal chamber extending upwardly away from said inboard shaft seal, thereby providing a limited volume within said seal chamber for containing gas above the height of said inboard shaft seal.

12. A submersible motor and pump assembly according to claim 11, further comprising a buffer fluid circulation impeller mounted on said shaft within said seal chamber proximate said outboard shaft seal, at least one passageway within said impeller connecting a rotationally normally forward facing intake tube on the periphery of said impeller to a discharge port on the hub of said impeller proximate said outboard shaft seal, and a multiplicity of radially oriented stator flanges in said seal chamber outboard of said impeller, one edge of said flanges being closely adjacent the arc of rotation of said intake tube.

13. A submersible motor and pump assembly comprising a motor and motor housing, said motor having an output shaft, a pump and pump housing, said pump housing connected to said motor housing, said pump being driven by said output shaft, an inboard shaft seal on said shaft proximate said motor, an outboard shaft seal on said shaft proximate said pump, a seal chamber interspersed between said motor and said pump, said seal chamber comprising in part the chamber side faces of said inboard shaft seal and said outboard shaft seal, said seal chamber charged with a buffer fluid, a buffer fluid circulation impeller with a hub and a periphery, said impeller mounted on said shaft within said seal chamber proximate said outboard shaft seal, said impeller having at least one internal passageway connecting a rotationally normally forward facing intake tube on said periphery to a discharge port on said hub proximate said outboard shaft seal, and a multiplicity of radially oriented stator flanges in said seal chamber outboard of said impeller, one edge of said flanges being closely adjacent the arc of rotation of said intake tube.

14. A submersible motor and pump assembly according to claim 13, further comprising a seal chamber pressurization system and at least one pressure reservoir integral to said motor and pump assembly for maintaining a positive pressure gradient within said seal chamber across said shaft seals, said integral seal chamber pressurization system comprising a capacity for buffer fluid in excess of such volume as is calculated to be lost due to leakage through said shaft seals during a period of normal operation of said motor and pump assembly, said pressure reservoir communicating with said seal chamber so as to maintain said positive pressure gradient during said operation.

15. A submersible motor and pump assembly according to claim 14, said impeller further comprising at least one internal passageway connecting a rotationally normally rearward facing discharge port on said periphery to a hub intake port on said hub proximate said outboard shaft seal.

16. A submersible motor and pump assembly comprising a motor and motor housing, said motor having an output shaft, a pump and pump housing, said pump housing connected to said motor housing, said pump being driven by said output shaft, an inboard shaft seal proximate said motor, said shaft seal including a rotating component, an outboard shaft seal proximate said pump, a seal chamber interspersed between said motor and said pump, a removable shaft sleeve mounted on said shaft within said seal chamber, said rotating component of said inboard shaft seal mounted on said sleeve, and a shaft bearing and bearing support structure within said seal chamber, said shaft bearing mounted on said sleeve.

17. A submersible motor and pump assembly according to claim 16, further comprising a buffer fluid circulation impeller within said seal chamber, said impeller mounted on said sleeve.

18. A submersible motor and pump assembly according to claim 17, said buffer fluid circulation impeller comprising a hub and a periphery, said impeller having at least one internal passageway connecting a rotationally normally forward facing intake tube on said periphery to a discharge port on said hub proximate said outboard shaft seal, said seal chamber configured with a multiplicity of radially oriented stator flanges outboard of said impeller, one edge of said flanges being closely adjacent the arc of rotation of said intake tube.

19. A submersible motor and pump assembly according to claim 18, further comprising motor cooling passageways in said motor housing, said motor cooling passageways communicating with said seal chamber, said impeller providing pressure for flowing said buffer fluid therein.

20. A submersible motor and pump assembly according to claim 19, said impeller further comprising at least one internal passageway connecting a rotationally normally rearward facing discharge port on said periphery to a hub intake port on said hub.

* * * * *

UNITED STATES PATENT AND TRADEMARK OFFICE

CERTIFICATE OF CORRECTION

PATENT NO. : 6,379,127 B1 
DATED : April 30, 2002
INVENTOR(S) : Dale B. Andrews, D. Paul Russell and Michael C. Witzgall It is certified that error appears in the above-identified patent and that said Letters Patent is hereby corrected as shown below:

Title page,
Item [60], Related U.S. Application Data, insert:

-- Related U.S. Application Data
Provisional application No. 60/157,702, filed on Dec. 04, 1999 --.

Signed and Sealed this

Tenth Day of June, 2003

JAMES E. ROGAN
*Director of the United States Patent and Trademark Office*